US011162315B2

(12) United States Patent
Harrington et al.

(10) Patent No.: US 11,162,315 B2
(45) Date of Patent: Nov. 2, 2021

(54) WINDOW MILL AND WHIPSTOCK CONNECTOR FOR A RESOURCE EXPLORATION AND RECOVERY SYSTEM

(71) Applicant: Baker Hughes Oilfield Operations LLC, Houston, TX (US)

(72) Inventors: Kevin Edgar Harrington, Milano, TX (US); Gregory Hern, Porter, TX (US); Philip M. Gregurek, Pearland, TX (US); Jason Cullum, League City, TX (US); Valerie Ferdin, Spring, TX (US); Gaute Grindhaug, Hafrsfjord (NO); Morten Eidem, Trondheim (NO)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/829,064

(22) Filed: Mar. 25, 2020

(65) Prior Publication Data

US 2021/0301615 A1 Sep. 30, 2021

(51) Int. Cl.
*E21B 29/06* (2006.01)

(52) U.S. Cl.
CPC ..... *E21B 29/06* (2013.01)

(58) Field of Classification Search
CPC ..... E21B 29/06
USPC ..... 166/380
See application file for complete search history.

(56) References Cited

U.S. PATENT DOCUMENTS 5,109,924 A 5/1992 Juergens et al.
5,431,220 A 7/1995 Lennon et al.
5,474,126 A 12/1995 Lynde et al.
5,709,265 A 1/1998 Haugen et al.
5,803,176 A 9/1998 Blizzard, Jr. et al.
5,878,818 A 3/1999 Hebert et al.
6,032,740 A 3/2000 Schnitker et al.
6,464,002 B1 10/2002 Hart et al.
6,695,056 B2 * 2/2004 Haugen ..... E21B 7/061 166/117.6
7,878,253 B2 2/2011 Stowe et al.
(Continued)

FOREIGN PATENT DOCUMENTS

EP 0916014 A1 5/1999
WO 2016209686 A1 12/2016

OTHER PUBLICATIONS

"Timken introduces two high performance alloy steel grades" Offshore Magazine, Offshore Staff, Nov. 11, 2013 (5 pages).
(Continued)

*Primary Examiner* — Taras P Bemko
(74) *Attorney, Agent, or Firm* — Cantor Colburn LLP

(57) ABSTRACT

A window cutting system includes a window mill having a body including a connector member, a tip portion, and a plurality of blades arranged between the connector member and the tip portion. Each of the plurality of blades supports a plurality of cutting elements. A lug pocket is formed in at least one of the plurality of blades adjacent the plurality of cutting elements. A whipstock connector detachably coupled to the window mill. The whipstock connector including an outer surface and an inner surface, and at least one lug projecting radially inwardly from the inner surface. The at least one lug is selectively received by the lug pocket to connect the whipstock connector to the window mill.

27 Claims, 17 Drawing Sheets

(56) References Cited

U.S. PATENT DOCUMENTS

| | | | | |
|---|---|---|---|---|
| 8,327,944 | B2 | 12/2012 | King et al. | |
| 8,967,279 | B2 | 3/2015 | Hered et al. | |
| 10,227,823 | B2 | 3/2019 | Hern et al. | |
| 10,724,319 | B2 * | 7/2020 | Hulsewe | E21B 7/061 |
| 2002/0170713 | A1 | 11/2002 | Haugen et al. | |
| 2004/0238171 | A1 | 12/2004 | McGarian et al. | |
| 2005/0039905 | A1 * | 2/2005 | Hart | E21B 10/55 166/55.7 |
| 2007/0044954 | A1 | 3/2007 | Dewey | |
| 2009/0266544 | A1 | 10/2009 | Redlinger et al. | |
| 2010/0270031 | A1 | 10/2010 | Patel | |
| 2010/0307736 | A1 | 12/2010 | Hearn et al. | |
| 2010/0319997 | A1 | 12/2010 | King et al. | |
| 2012/0255785 | A1 * | 10/2012 | Gregurek | E21B 7/061 175/57 |
| 2012/0261193 | A1 | 10/2012 | Swadi et al. | |
| 2013/0020084 | A1 * | 1/2013 | Goodson | E21B 7/061 166/298 |
| 2015/0152703 | A1 | 6/2015 | Haun | |
| 2016/0238055 | A1 | 8/2016 | Donovan | |
| 2016/0348456 | A1 | 12/2016 | Laplante et al. | |
| 2017/0328177 | A1 * | 11/2017 | Sheehan | E21B 7/061 |
| 2018/0209232 | A1 | 7/2018 | Hulsewe | |
| 2018/0209233 | A1 * | 7/2018 | Hulsewe | E21B 29/06 |
| 2018/0320480 | A1 | 11/2018 | Jelly et al. | |
| 2018/0334872 | A1 * | 11/2018 | Vuyk, Jr. | E21B 41/0035 |
| 2019/0003264 | A1 | 1/2019 | Swadi et al. | |
| 2019/0120005 | A1 | 4/2019 | Hulsewe | |
| 2020/0011134 | A1 | 1/2020 | Nevlud et al. | |

OTHER PUBLICATIONS

C95400 Product Spec Sheet; Concast Metal Products, Jul. 27, 2010 (pp. 1-2).

C95510 Product Spec Sheet; Concast Metal Products, Dec. 22, 2010 (pp. 1-2).

Notification of Transmittal of the International Search Report and the Written Opinion of the International Searching Authority, or the Declaration; PCT/US2017/066117; dated Mar. 29, 2018; 13 pages.

Notification of Transmittal of the International Search Report and the Written Opinion of the International Searching Authority, or the Declaration; PCT/US2017/066119; dated Mar. 29, 2018; 10 pages.

* cited by examiner

WINDOW MILL AND WHIPSTOCK CONNECTOR FOR A RESOURCE EXPLORATION AND RECOVERY SYSTEM

BACKGROUND

In the drilling and completion industry, boreholes are formed in a formation for the purpose of locating, identifying, and withdrawing formation fluids. Once formed, a casing may be installed in the borehole to support the formation. Often times, it is desirable to create a branch from the borehole. A whipstock is used to guide a window mill supported on a drillstring through the casing into the formation at an angle relative to the borehole. The whipstock directs the window mill to form a window or opening in the casing.

Generally, the window mill/whipstock is made up on a rig floor. The window mill includes a threaded hole and the whipstock includes a lug hole. Typically, the whipstock is mounted in a rotary table and the window mill is brought into position such that the threaded hole and lug hole are aligned. A shear bolt is passed through the lug hole and connected with the window mill. Aligning the openings and connecting the shear bolt at the rig floor can be a difficult and time-consuming process. Given the need to increase efficiency at the rig floor, the art would be open to new systems for joining a window mill to a whipstock.

SUMMARY

Disclosed is a window cutting system includes a window mill having a body including a connector member, a tip portion, and a plurality of blades arranged between the connector member and the tip portion. Each of the plurality of blades supports a plurality of cutting elements. A lug pocket is formed in at least one of the plurality of blades adjacent the plurality of cutting elements. A whipstock connector detachably coupled to the window mill. The whipstock connector including an outer surface and an inner surface, and at least one lug projecting radially inwardly from the inner surface. The at least one lug is selectively received by the lug pocket to connect the whipstock connector to the window mill.

Also disclosed is a resource exploration and recovery system including a first system, a second system coupled to the first system. The second system includes a casing tubular extending into a formation and a casing window cutting system extending into the casing tubular from the first system. The casing window cutting system includes a window mill having a body including a connector member, a tip portion, and a plurality of blades arranged between the connector member and the tip portion. Each of the plurality of blades supports a plurality of cutting elements. A lug pocket is formed in at least one of the plurality of blades adjacent the plurality of cutting elements. A whipstock connector detachably coupled to the window mill. The whipstock connector including an outer surface and an inner surface, and at least one lug projecting radially inwardly from the inner surface. The at least one lug is selectively received by the lug pocket to connect the whipstock connector to the window mill.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
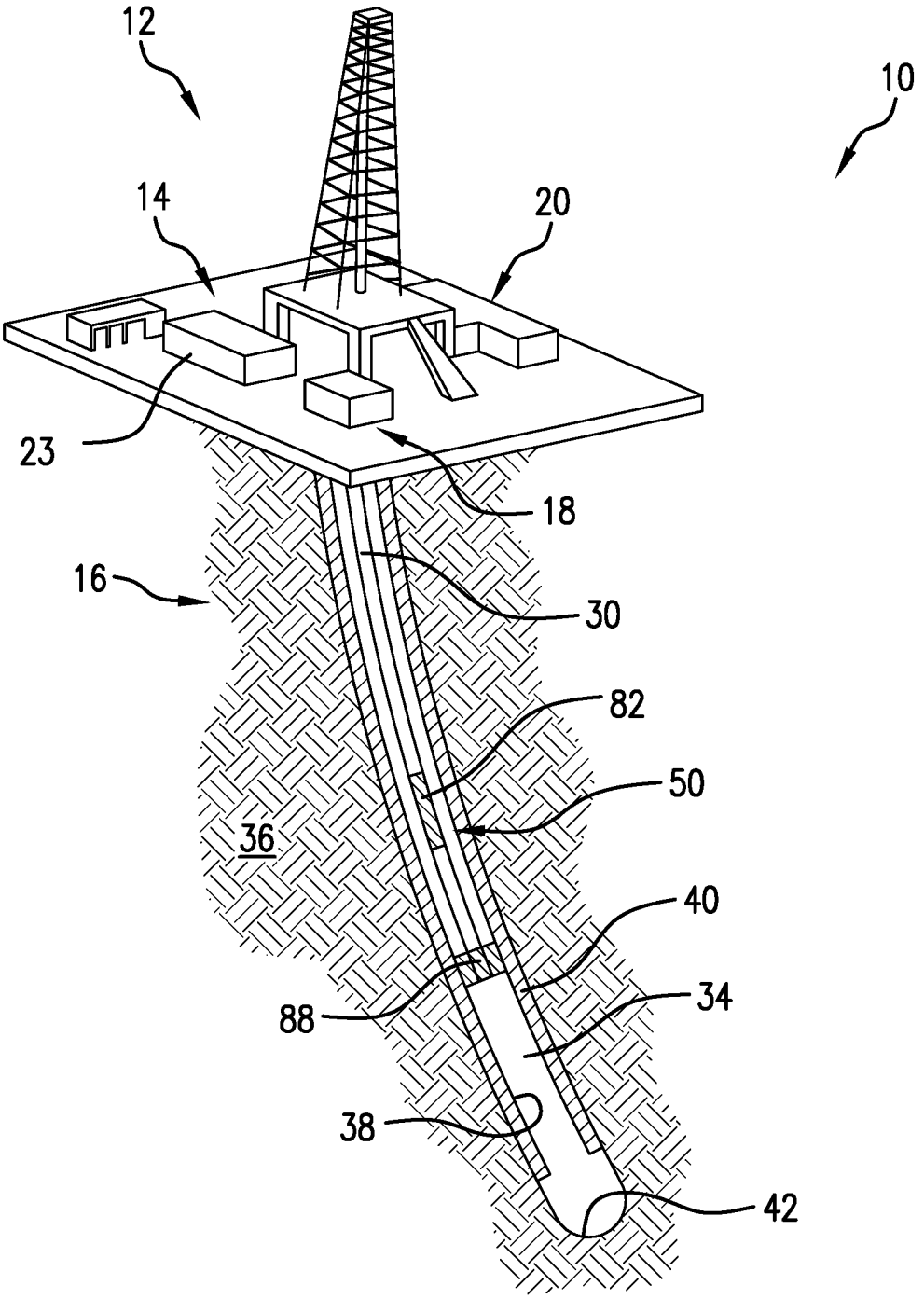
FIG. 1 depicts a resources exploration and recovery system including a window mill and whipstock connector, in accordance with an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 12 which, in some environments, may take the form of a surface system 14 operatively and fluidically connected to a second system 16 which, in some environments, may take the form of a subsurface system.

First system 12 may include pumps 18 that aid in completion and/or extraction processes as well as fluid storage 20. Fluid storage 20 may contain a stimulation fluid which may be introduced into second system 16. First system 12 may also include a control system 23 that may monitor and/or activate one or more downhole operations. Second system 16 may include a tubular string 30 formed from a plurality of tubulars (not separately labeled) that is extended into a wellbore 34 formed in formation 36. Wellbore 34 includes an annular wall 38 that may be defined by a casing tubular 40 that extends from first system 12 towards a toe 42 of wellbore 34.

Figure 2:
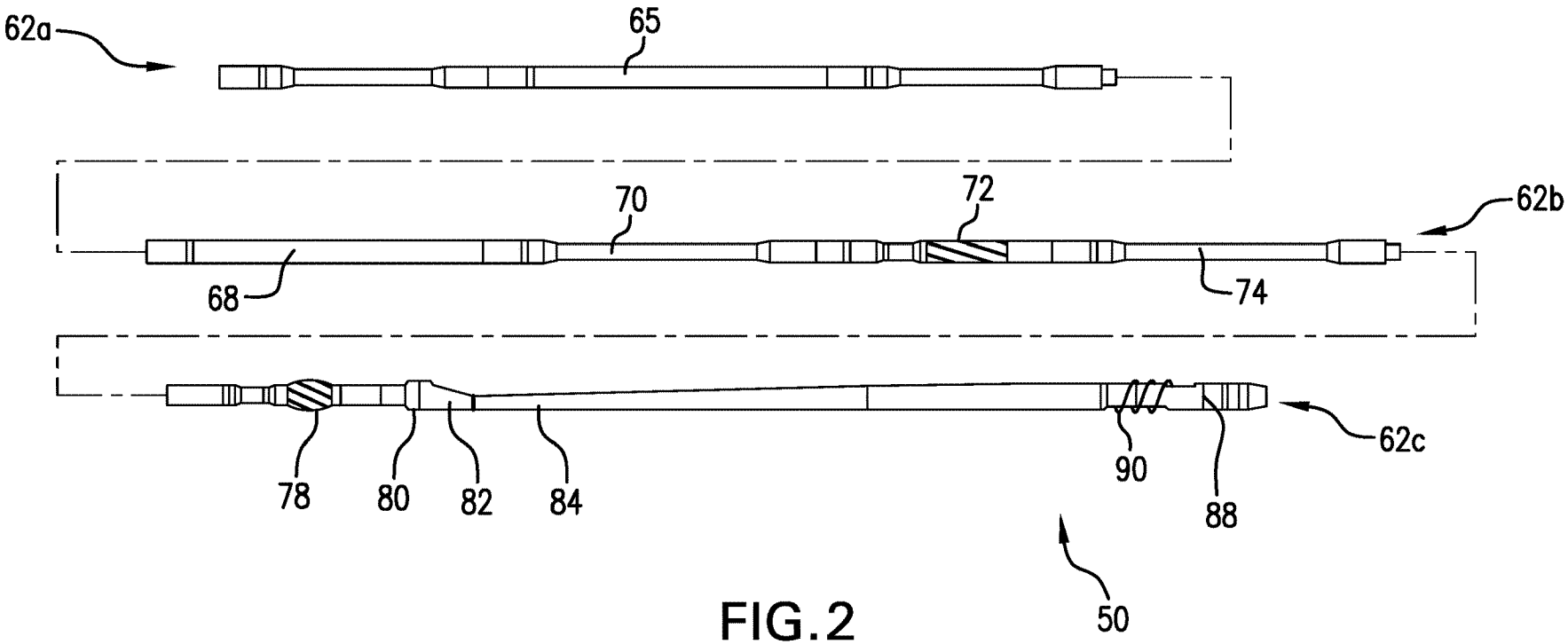
FIG. 2 depicts a window cutting system including a window mill and whipstock connector, in accordance with an exemplary embodiment.

In accordance with an exemplary aspect, a window cutting system 50 is connected to tubular string 30 as is introduced into wellbore 34. Window cutting system 50 is lowered to a selected depth, affixed to casing tubular 40, and activated to form a window. The window represents an opening in casing tubular 40 that allows a branch to be formed from wellbore 34. In the embodiment shown, window cutting system 50 is formed from a number of tubular segments 62*a*, 62*b*, and 62*c* as shown in FIG. 2. Each segment 62*a*, 62*b*, and 62*c* may be made up off-site and delivered to first system 12 for introduction into wellbore 34.

In an embodiment, first segment 62*a* may support a measurement while drilling (MWD) system 65 that includes various instrumentation systems that monitor window cutting operations. Of course, it should be understood, that other measurement systems may also be employed. Second segment 62*h* may include a whipstock valve 68, a first flex joint 70, an upper watermelon mill 72, and a second flex joint 74. Third segment 62*c* may include a lower watermelon mill 78, a window mill 80, a whipstock connector 82, a whipstock 84, and an anchor 88. Whipstock connector 82 may be welded to whipstock 84. A brush or scraper 90 may be arranged on third segment 62*c* adjacent anchor 88. Whipstock connector 82 serves as an interface between window mill 80 and whipstock 84. As will be detailed herein, whipstock connector 82 may support axial loads, rotational loads in one direction while also including frangible elements that allow for a separation of window mill 80 through rotation in a second direction.

Figure 3:
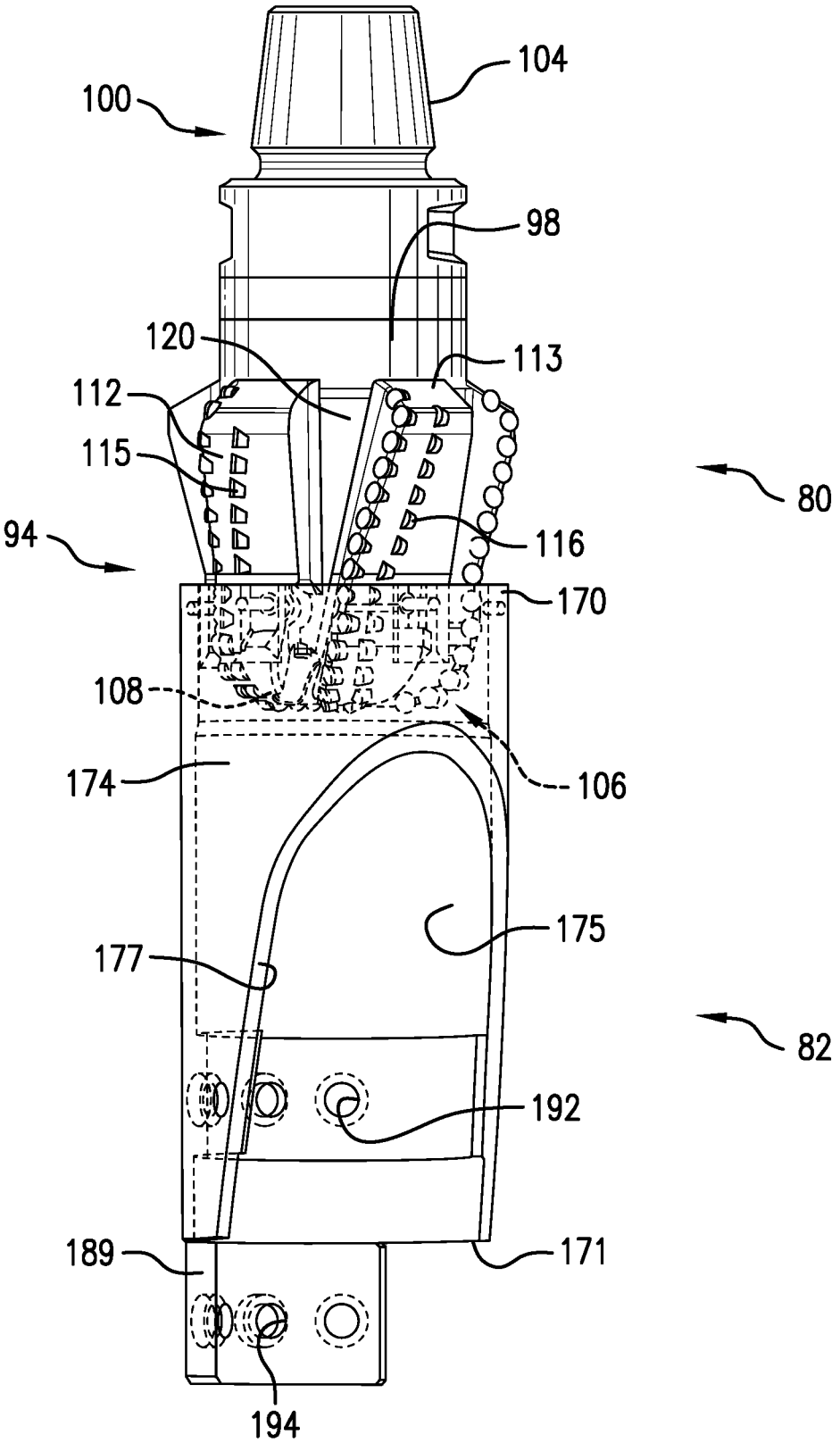
FIG. 3 depicts the window mill coupled to the whipstock connector, in accordance with an aspect of an exemplary embodiment.
Figure 4:
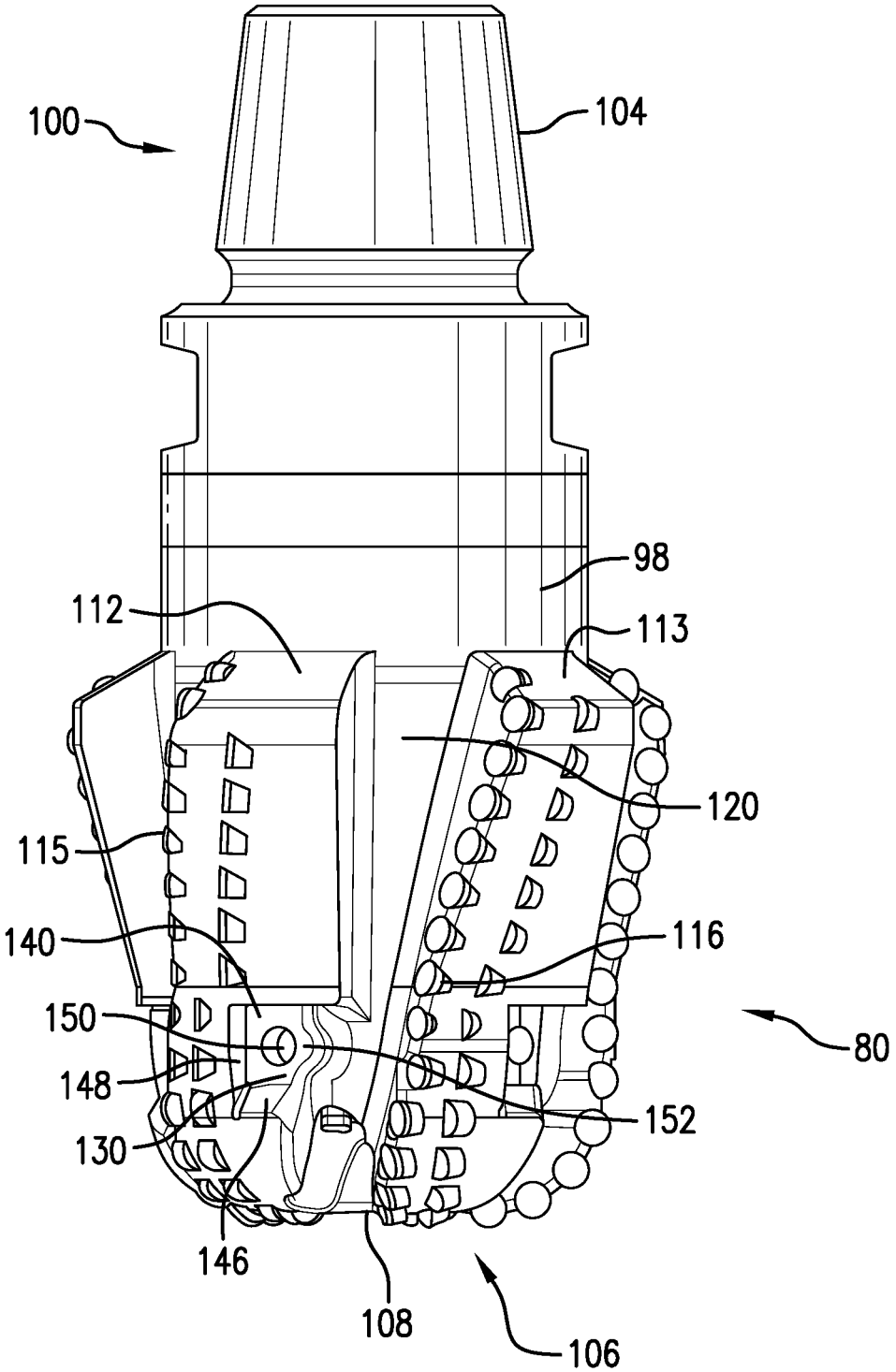
FIG. 4 depicts a window mill including a lug pocket, in accordance with an exemplary aspect.

Referring to FIGS. 3 and 4, window mill 80 is secured to whipstock connector 82 through a connection system 94 as will be detailed herein. In accordance with an exemplary aspect, window mill 80 includes a body 98 having a first end section 100 including a connector member 104 and a second end section 106 defining a tip portion 108. Connector member 104 provides an interface with lower watermelon mill 78 as shown in FIG. 2. Window mill 80 includes a plurality of blades, two of which are indicated at 112 and 113 that extend between first end section 100 and second end section 106. Each of the plurality of blades 112, 113 include a plurality of cutting elements indicated at 115 and 116 respectively. In the embodiment shown, a gap or junkslot 120 is defined between adjacent ones of the plurality of blades 112 and 113. At this point, it should be understood that while two blades are referenced, additional blades are present and the number of blades on body 98 may vary.

Figure 5:
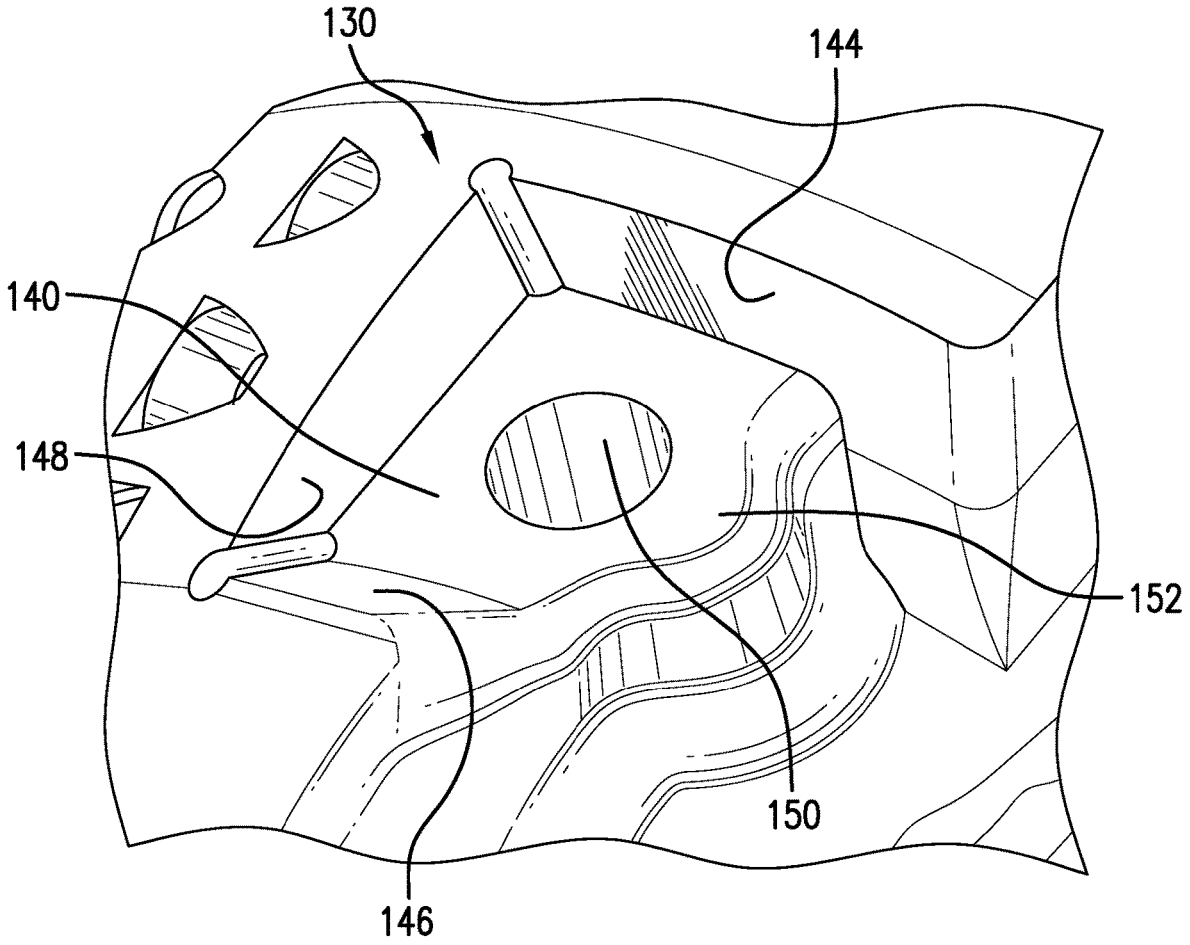
FIG. 5 is a detail view of the lug pocket of FIG. 4, in accordance with an exemplary embodiment.

In accordance with an exemplary embodiment, window mill 80 includes a plurality of lug pockets, one of which is indicated at 130 that provide an interface with whipstock connector 82 as will be detailed herein. Each lug pocket 130 is formed in a corresponding one of the plurality of blades 112, 113 and others. Referring to FIG. 5, each lug pocket 130 includes a base wall 140, a first side wall 144, a second side wall 146 and a connecting wall 148. The geometry of each lug pocket allows segment 62*c* to support whipstock connector 82 when being raised for insertion into wellbore 34.

Figure 6:
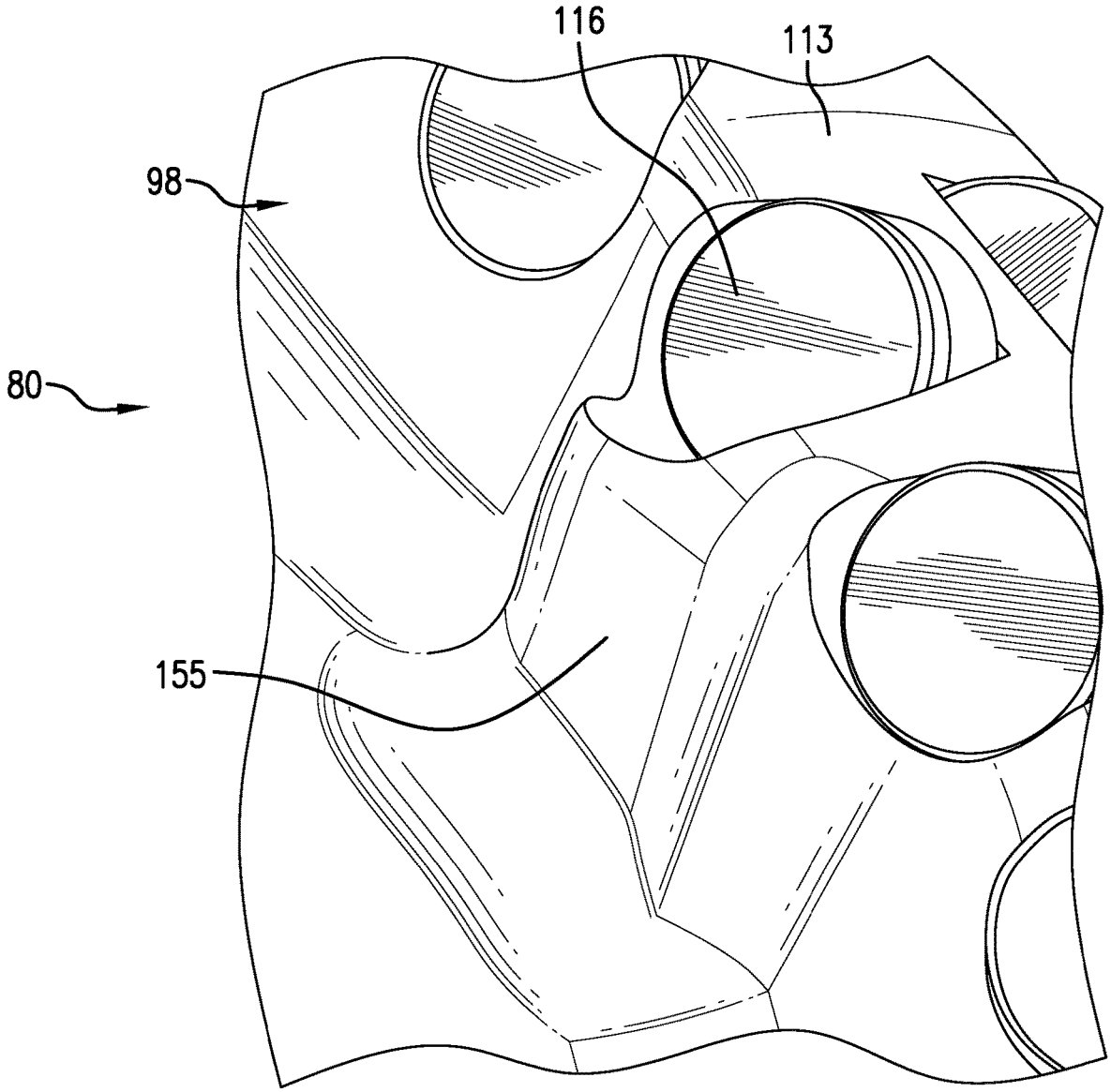
FIG. 6 depicts additional material added at a blade of the window mill of FIG. 4, in accordance with an aspect of an exemplary embodiment.

First side wall 144 is closer to first end section 100 than second side wall 146. Base wall 140 includes a recess 150. Second side wall 146 includes an angled or chamfered surface (not separately labeled). Base wall 140 also includes an extended region 152 that protrudes toward gap 120. Extended region 152 provides additional material around recess 150 to enhance load carrying capability of lug pocket 130. In addition, each of the plurality of blades includes an increased thickness zone or impact stop 155 such as shown on blade 113 in FIG. 6. Increased thickness zone 155 provides protection for cutting elements 116 when window mill 80 is released from whipstock connector 82 as will be detailed herein. Increased thickness zone 155 also shields blade 113 from torque loads that could damage cutting elements 115 and 116. In addition, the plurality of blades is asymmetrical so as to allow window mill 80 to key into window mill connector 82 in a selected orientation.

Figure 7:
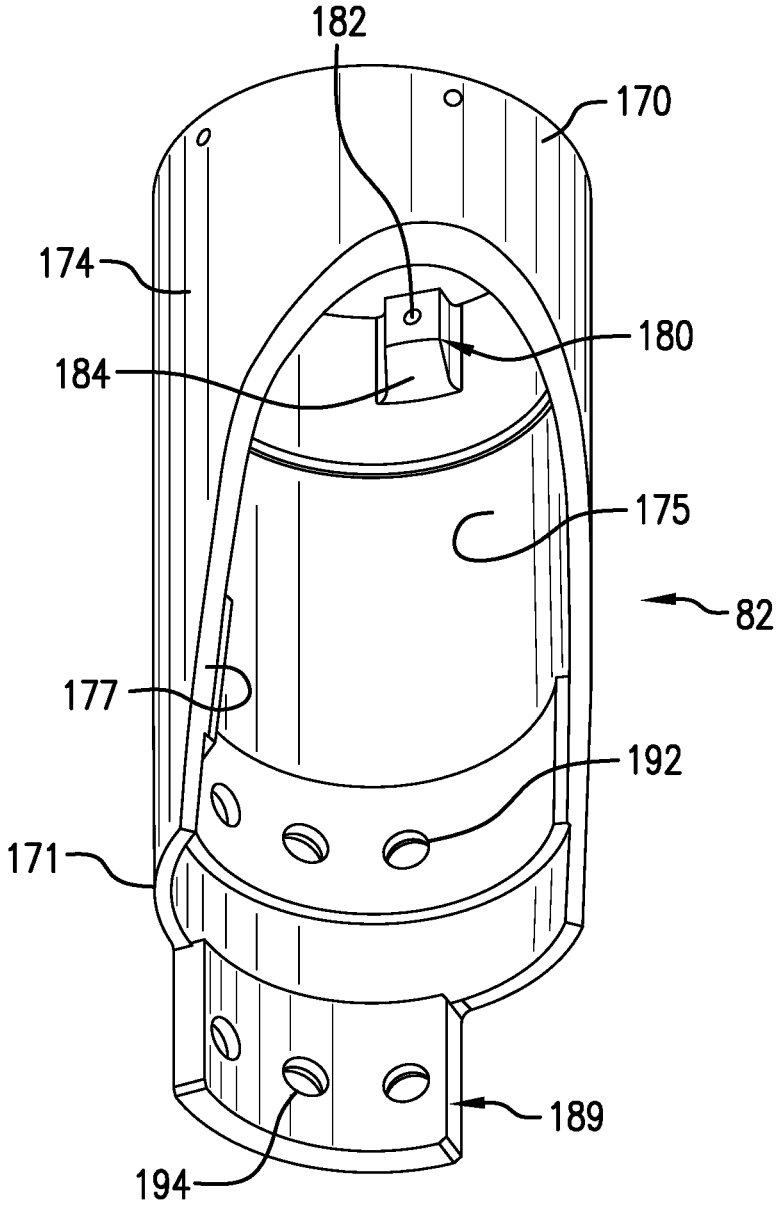
FIG. 7 depicts a perspective view of a first end of the whipstock connector of FIG. 3, in accordance with an exemplary aspect.
Figure 8:
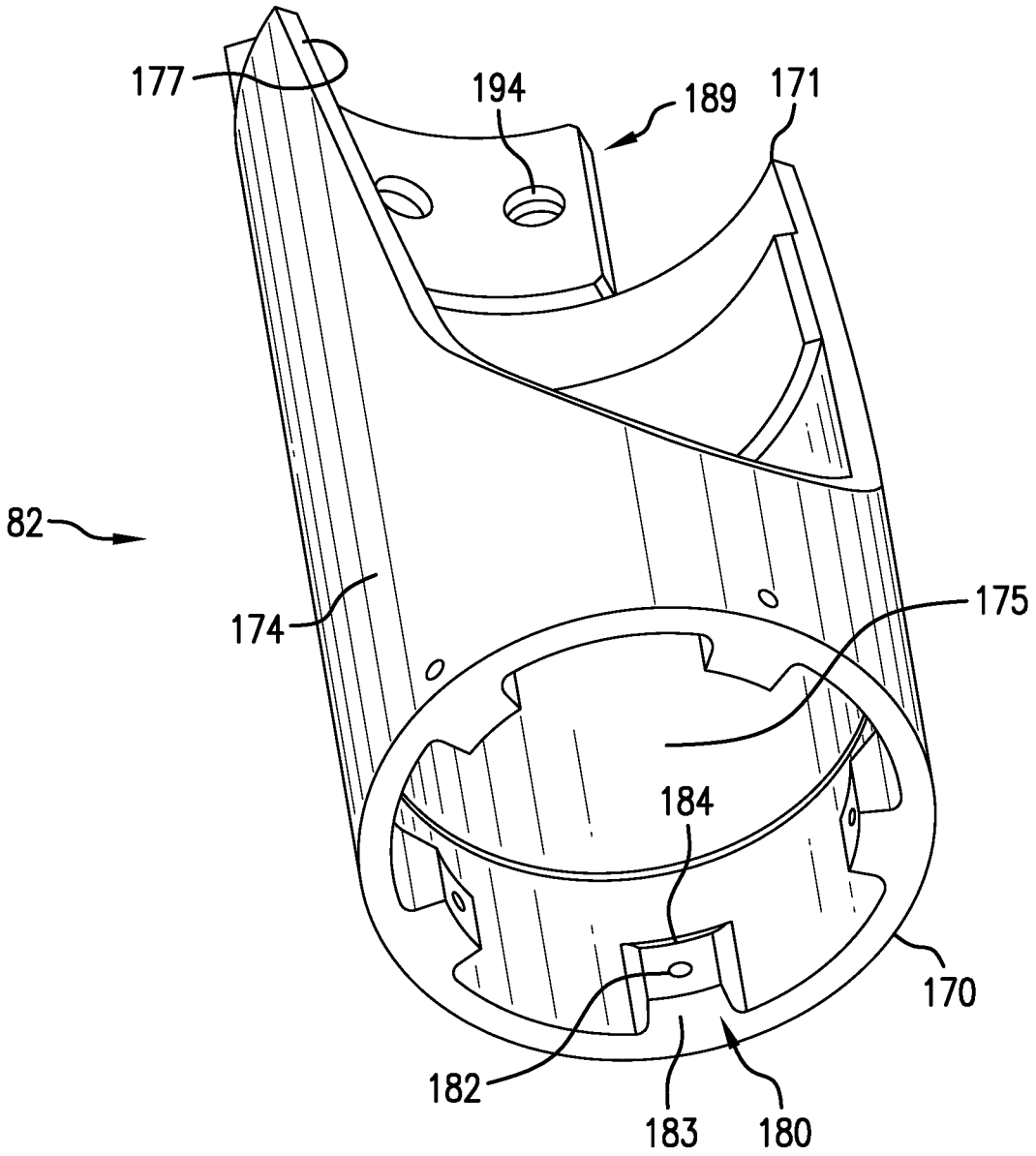
FIG. 8 depicts a perspective view of a second end of the whipstock connector of FIG. 3, in accordance with an exemplary aspect.

Reference will now follow to FIGS. 7 and 8 in describing whipstock connector 82 in accordance with an aspect of an exemplary embodiment. Whipstock connector 82 includes a first end 170 and a second end 171. Whipstock connector 82 also includes an outer surface 174 and an inner surface 175. An opening 177 is formed in Whipstock connector 82. Opening 177 extends from second end 171 toward first end 170.

In accordance with an exemplary aspect, whipstock connector 82 includes a plurality of lugs, one of which is indicated at 180, that project radially inwardly from inner surface 175. Each lug 180 includes a radially extending threaded passage 182, a first surface 183 arranged at first end 170 and an opposing angled surface 184. Each lug 180 is received in a corresponding one of lug pockets 130 such that angled surface 184 rests upon the chamfer (not separately labeled) formed on second side watt 146. First surface 183 cooperates with first side wall 144 and acts as a travel limiter that prevents window mill 80 from inserting too far into Whipstock connector 82.

Figure 9:
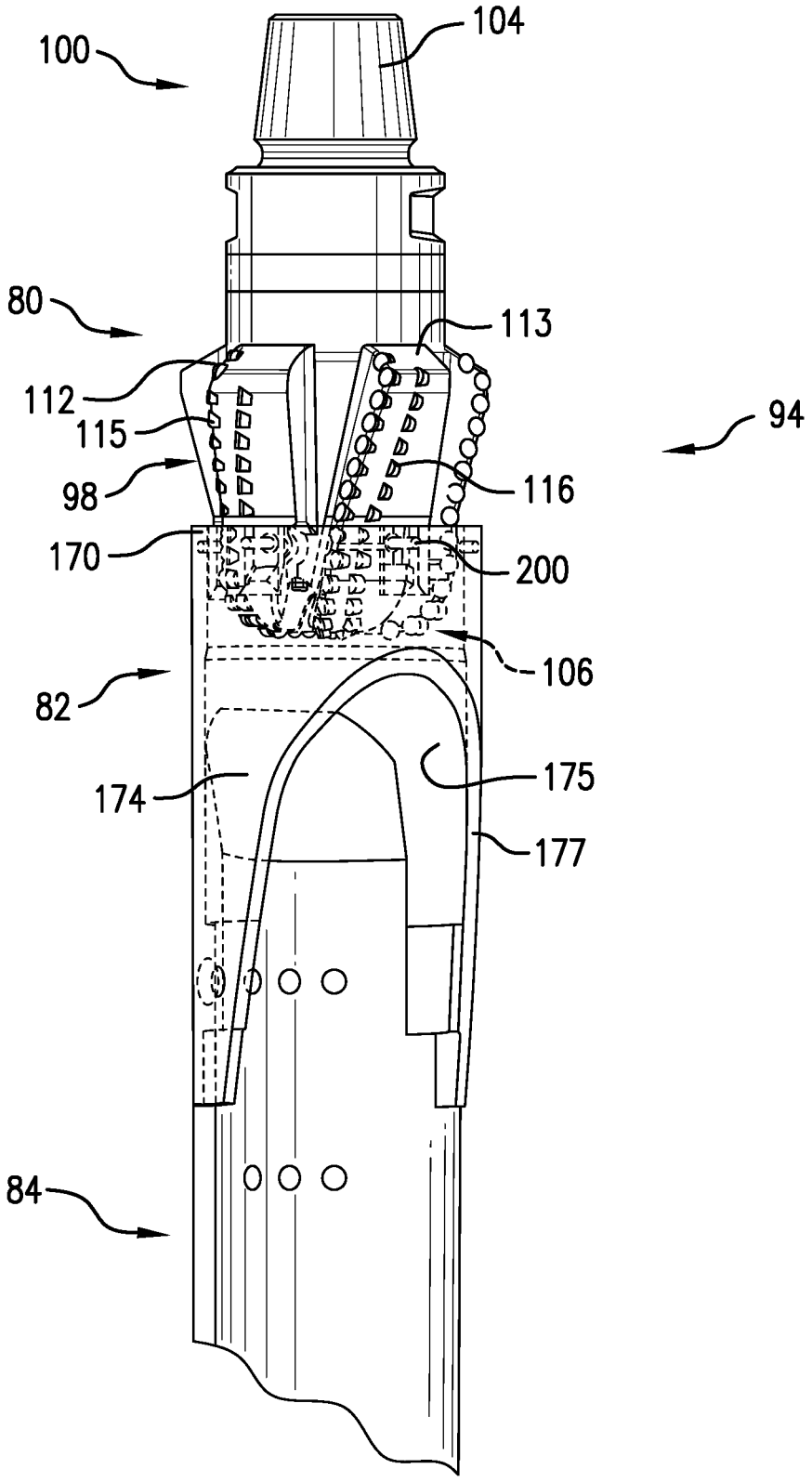
FIG. 9 depicts the window mill and whipstock connector of FIG. 3 connected to a whipstock, in accordance with an aspect of an exemplary embodiment.

Whipstock connector 82 also includes a tab element 189. A first plurality of openings 192 may extend through whipstock connector 82 at a position spaced from second end 171. A second plurality of openings 194 may extend through tab element 189, First and second pluralities of openings 192 and 194 may receive mechanical fasteners (not separately labeled) that secure whipstock connector 82 to whipstock 84 as shown in FIG. 9. Of course, it should be understood that other mechanisms, such as welding, and the like may be used to join whipstock connector 82 to whipstock 84.

In accordance with an exemplary aspect, third tubular section 62*c* may be assembled off-sight and delivered to, for example, first system 12. Window mill 80 may be installed into first end 170 of whipstock connector 82. Window mill 80 may be rotated to align lugs 180 with, and nest into lug pockets 130. The direction of rotation may be clockwise from above. However, it should be understood that the direction of rotation may vary. At this point, a frangible bolt 200 (FIG. 9) may be threaded into each passage 182 and engaged with a corresponding one of recesses 150. At this point it should be understood that either passage 182 or recess 150 may be threaded to retain frangible bolt 200. When ready to be installed into wellbore 34, third tubular section 62*c* may be hoisted and lowered into position and held at a rotary table (not shown). Second tubular section 62*b* may be brought into position and connected with third tubular section 62*c*.

The remaining portions of tubular string 30, including first tubular section 62*a*, may be connected and window cutting system 50 lowered into wellbore 34. Engagement between first wall 183 of each lug 180 and corresponding ones of first and second side walls 144 and 146 of each lug pocket 130 supports high push and pull forces associated with tripping in tubular string 30 to a desired depth. Once in position, anchor 88 may be deployed and, in accordance with an exemplary aspect, a clockwise rotary force imparted to window mill 80 causing frangible bolts 200 to shear. The rotary force may take the form of an anti-clockwise direction from above. At this point, a window cutting operation may commence.

With this arrangement, lug pockets 130 may support each lug 180 when third tubular section 62*c* is raised and hoisted into position. The interaction of lugs 180 with lug pockets 130 ensure that frangible bolts 200 are not exposed to any forces that would cause a premature separation of window mill 80 and whipstock connector 82. Further, the mating of angled surface 184 on each lug with the chamfer on each second side wall 146 provides increased load carrying capacity. By allowing third tubular section 62*c* to be assembled in this manner reduces time and effort at first system 12 thereby enhancing operational efficiencies.

For example, the window mill may be attached to the whipstock prior to picking up and deploying into the wellbore. Further, the connection between the window mill and the whipstock in accordance with exemplary embodiments allow string 30 to be rotated at 40 RPM or above during run-in. Further, the high push-pull capability allows for the use of telemetry to verify window mill location as well as the use (rotation and reciprocation) of brush and/or scraper 90 during deployment.

Figure 10A:
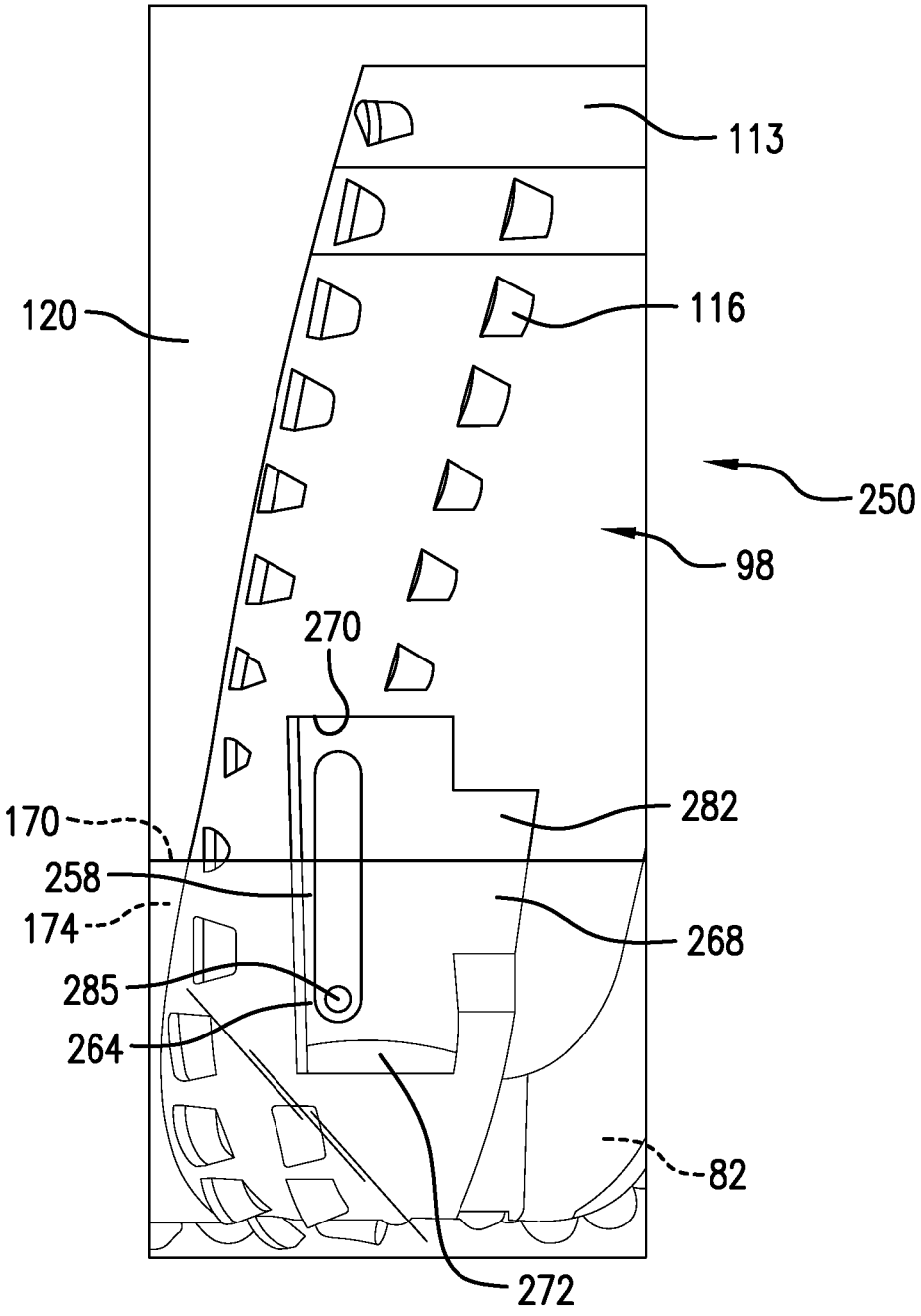
FIG. 10A depicts release system for a window mill and whipstock connector showing the whipstock connector hanging from the window mill in a torque application position, in accordance with another aspect of an exemplary embodiment.
Figure 10B:
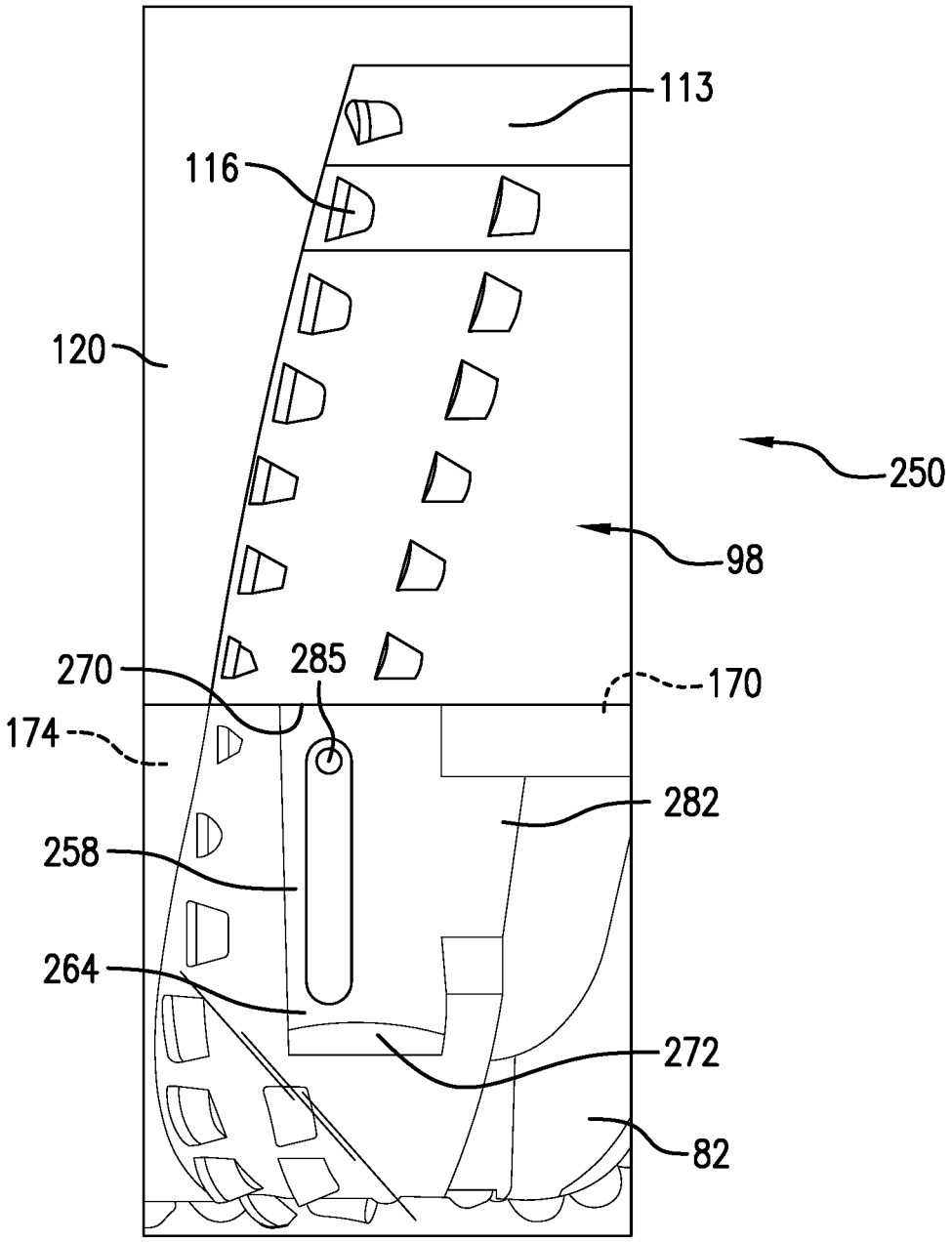
FIG. 10B depicts release system for a window mill and whipstock connector of FIG. 10A in run-in position with the window mill pushing on the whipstock connector.
Figure 10C:
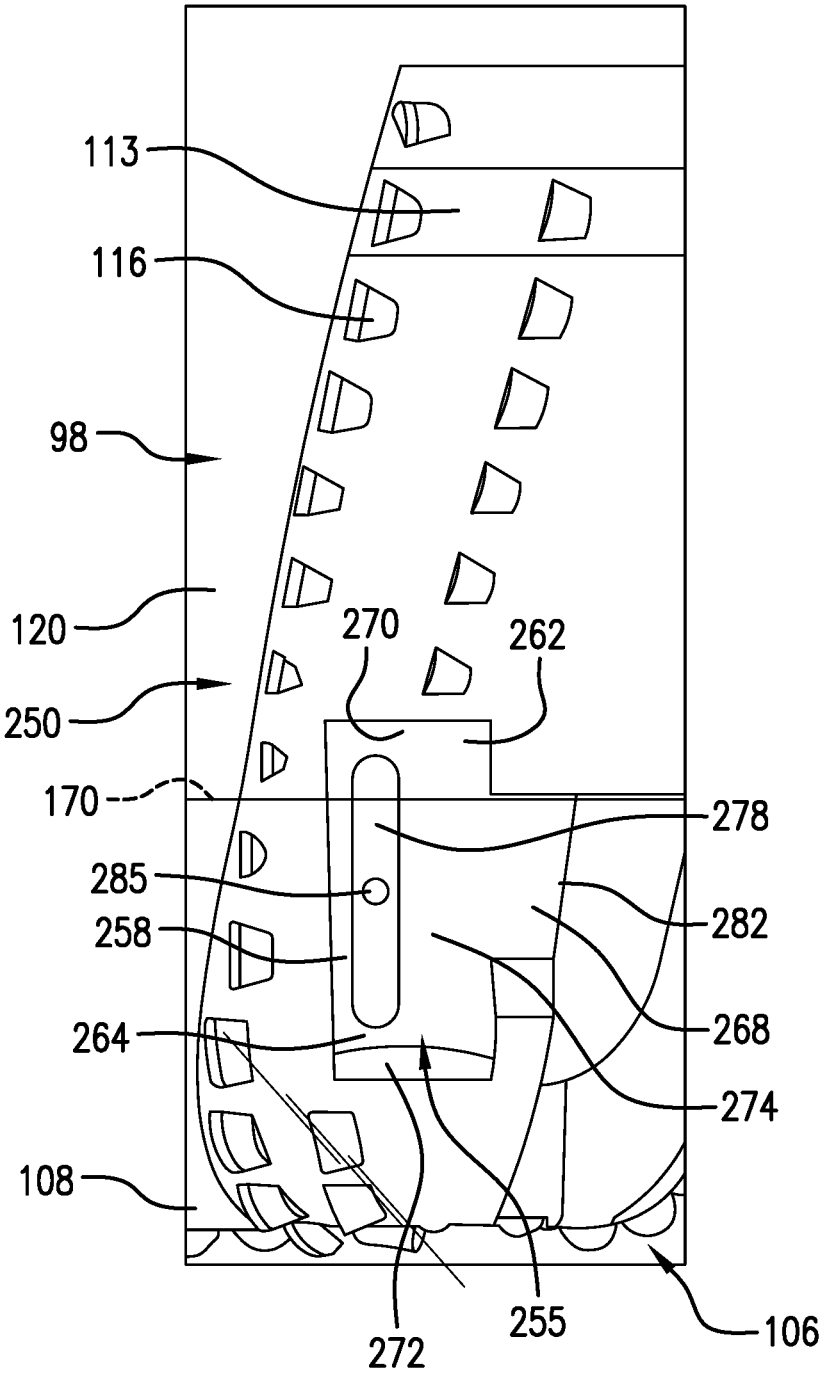
FIG. 10C depicts release system for a window mill and whipstock connector of FIG. 10A in a pre-release position.

Reference will now follow to FIGS. 10A-10C, wherein like reference numbers represent corresponding parts in the respective views, in describing a window mill 250 in accordance with another aspect of an exemplary embodiment. Window mill 250 includes a plurality of lug pockets, one of which is indicated at 255 that provide an interface with whipstock connector 82 as will be detailed herein. Each lug pocket 255 is formed in a corresponding one of the plurality of blades 112, 113 and others.

In the exemplary embodiment shown, each lug pocket 255 is generally T-shaped having a longitudinally extending leg 258 including a first or upper leg portion 262, an opposing second or lower leg portion 264, and a branch leg 268. Branch leg extends substantially perpendicularly from longitudinally extending leg 255 between first leg portion 262 and second leg portion 264. First leg portion 262 includes an upper wall 270 and second leg portion 264 includes a lower wall 272. A base wall 274 extends between upper wall 270 and lower wall 272. Base wall 274 extends into window mill 250 a first depth and includes a longitudinally extending slot 278.

In further accordance with an exemplary aspect, branch leg 268 extends outwardly between first leg portion 262 and second leg portion 264 and includes an angled base wall 282 that extends from the first depth of base wall 274 radially outwardly toward a surface (not separately labeled) of window mill 250. As will be detailed herein, angled base wall 282 defines a ramp that allows, for example, lug 180 to transition out of lug pocket 255.

Window mill 250 is coupled to whipstock connector 82 such that each lug 180 enters branch leg 268. Whipstock connector 82 and/or window mill 250 is rotated such that each lug settles between upper wall 270 and lower wall 272. A frangible fastener 285 is threshed into threaded passage 182. Fastener 285 passes through lug 180 and extends into slot 278. With this arrangement, lug 180 is constrained in lug pocket 255 and may travel between upper wall 270 and lower wall 272.

When ready to be installed into wellbore 34, third tubular section 62*c* may be hoisted and lowered into position and held at a rotary table (not shown). Second tubular section 62*b* may be brought into position and connected with third tubular section 62*c*. First tubular section 62*a* may then be connected with second tubular section 62*b* and tubular string 30 run into wellbore 34 to a selected depth at which point anchor 88 may be set.

During run in, it may be desirable to axially load tubular string 30 in compression and/or tension. In compression, lug 180 may travel into first leg portion 262 and abut upper wall 270 as shown in FIG. 10B. In tension, lug 180 may travel into second leg portion 264 and abut lower wall 272. With this arrangement, the window mill 250/whipstock connector 82 can withstand high loading in both tension and compression. Further, window mill 250 may be rotated such that lug 180 engages side surfaces (not separately labeled) of first leg portion 262 or second leg portion 264 as shown in FIG. 10C. First and second legs 262 and 264 enable window mill and whipstock 84 to withstand high rotary loads under both clockwise and counter-clockwise rotation. Thus, tubular string may be manipulated to clean internal surfaces of casing 40 with scraper or brush 90.

After setting anchor 88 it may be desired to separate window mill 250 and whipstock connector 82, lug 180 is positioned adjacent to branch leg 268 such as by lifting up or slacking off on tubular string 30. A rotary force is applied to window mill 250 causing frangible fastener 285 to fail, e.g., break shear etc. Lug 180 may then transition up angled base wall 282 and pass out of lug pocket 255. Tubular string 30 may then be lifted to separate window mill 250 from whipstock connector 82.

Figure 11A:
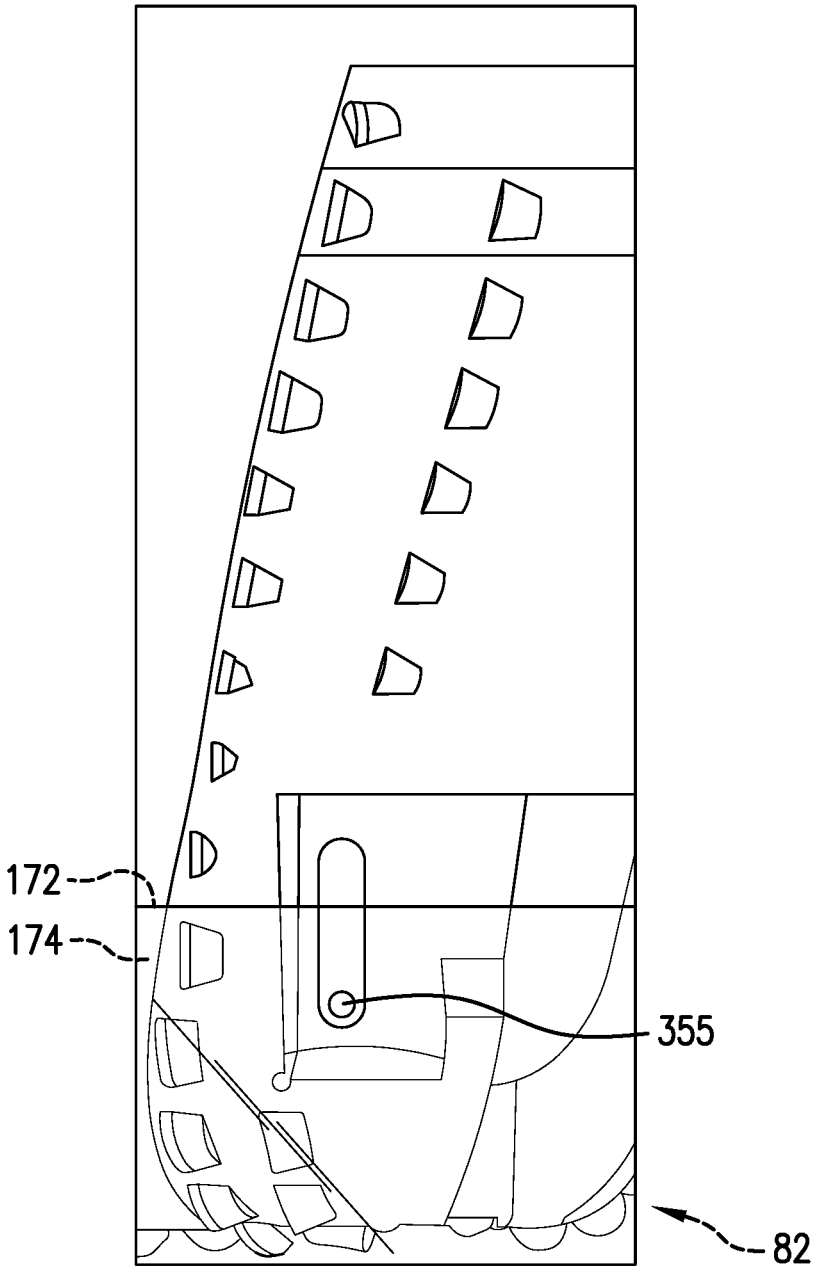
FIG. 11A depicts release system for a window mill and whipstock connector showing the whipstock connector hanging from the window mill in a torque application position, in accordance with yet another aspect of an exemplary embodiment.
Figure 11B:
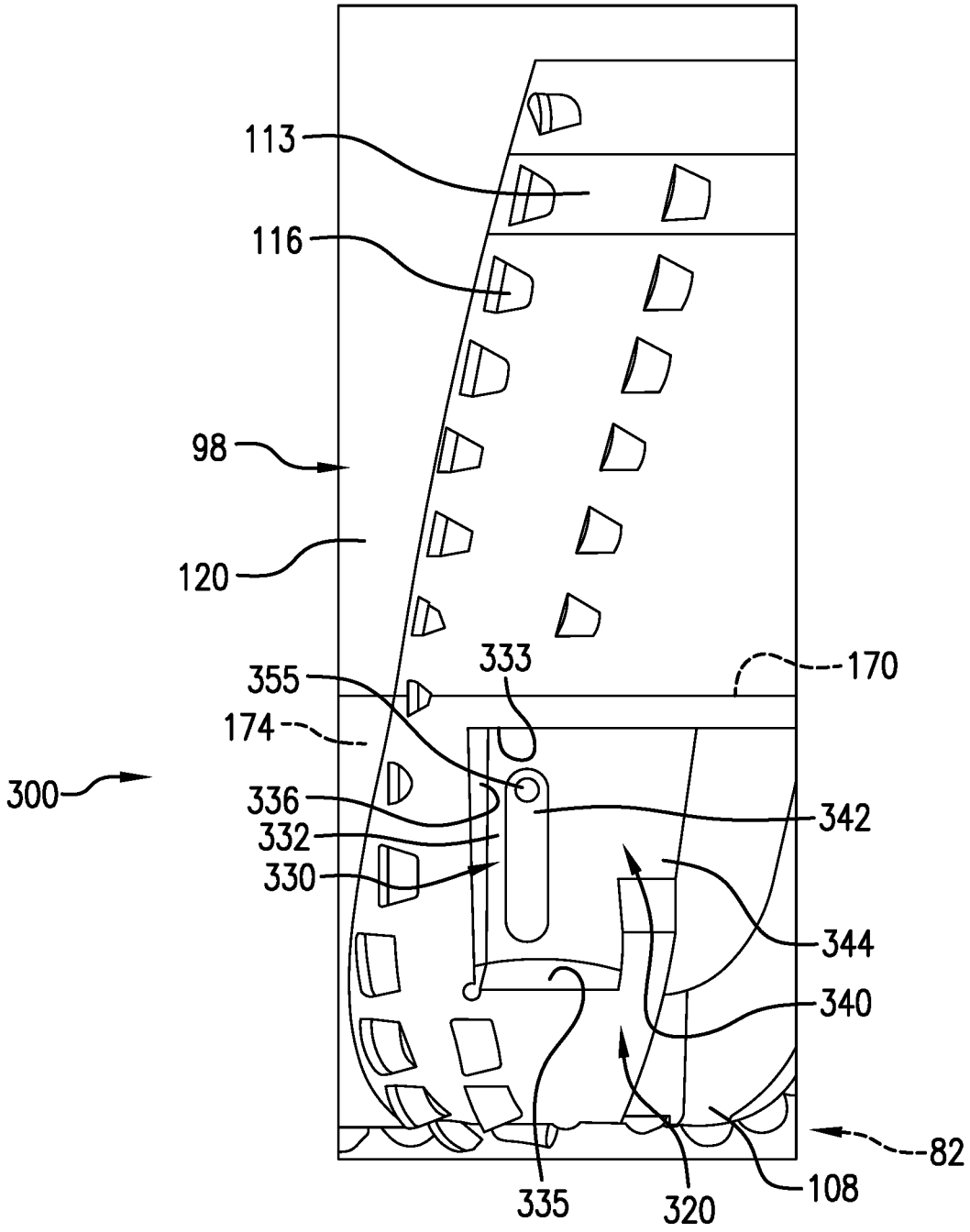
FIG. 11B depicts release system for a window mill and whipstock connector of FIG. 11A in a pre-release position.

Reference will now follow to FIGS. 11A-11B, wherein like reference numbers represent corresponding parts in the respective views, in describing a window mill 300 in accordance with yet another exemplary embodiment. Window mill 300 includes a plurality of lug pockets, one of which is indicated at 320 that provide an interface with whipstock connector 82 as will be detailed herein. Each lug pocket 320 is formed in a corresponding one of the plurality of blades 112, 113 and others.

In the exemplary embodiment shown, each lug pocket 320 has a generally inverted L-shape and includes a longitudinally extending leg 330 including a base wall 332, an upper wall 333, a lower wall 335, and a side wall 336. A branch leg 340 extends substantially perpendicularly outwardly of longitudinally extending leg 330 adjacent to upper wall 333. Longitudinally extending leg 330 includes a base wall 336 that extends between upper wall 333 and lower wall 335. Base wall 332 extends into window mill 300 a first depth and includes a longitudinally extending slot 342.

In further accordance with an exemplary aspect, branch leg 340 includes an angled base wall 344 that extends from the first depth of base wall 336 radially outwardly toward a surface (not separately labeled) of window mill 300. As will be detailed herein, angled base wall 344 defines a ramp that allows, for example, lug 180 to transition out of lug pocket 320.

Window mill 300 is coupled to whipstock connector 82 such that each lug 180 enters branch leg 340. Whipstock connector 82 and/or window mill 300 is rotated such that each lug 180 settles between upper wall 333 and lower wall 335. A frangible fastener 355 is threshed into threaded passage 182. Fastener 355 passes through lug 180 and extends into slot 342. With this arrangement, lug 180 is constrained in lug pocket 320 and may travel between upper wall 333 and lower wall 335.

When ready to be installed into wellbore 34, third tubular section 62*c* may be hoisted and lowered into position and held at a rotary table (not shown). Second tubular section 62*b* may be brought into position and connected with third tubular section 62*c*. First tubular section 62*a* may then be connected with second tubular section 62*b* and tubular string 30 run into wellbore 34 to a selected depth at which point anchor 88 may be set.

During run in, it may be desirable to axially load tubular string 30 in compression and/or tension. In compression, lug 180 may travel toward and engage upper wall 333 as shown in FIG. 11B. In tension, lug 180 may travel toward and engage lower wall 335. With this arrangement, the window mill 300/whipstock connector 82 can withstand high loading in both tension and compression. Further, window mill 300 may be rotated such that lug 180 engages side surfaces (not of lug pocket 320 at lower wall 335. Side surface of longitudinal slot 342 at lower wall 335 enables window mill and whipstock 84 to withstand high rotary loads under both clockwise and counter-clockwise rotation. Thus, tubular string may be manipulated to clean internal surfaces of casing 40 with scraper or brush 90.

After setting anchor 88 it may be desired to separate window mill 300 and whipstock connector 82, lug 180 is positioned adjacent to upper wall 333 such as by slacking off on tubular string 30. A rotary force is applied to window mill 300 causing frangible fastener 355 to fail, e.g., break shear etc. Lug 180 may then transition up angled base wall 344 and pass out of lug pocket 320. Tubular string 30 may then be lifted to separate window mill 300 from whipstock connector 82.

Figure 12A:
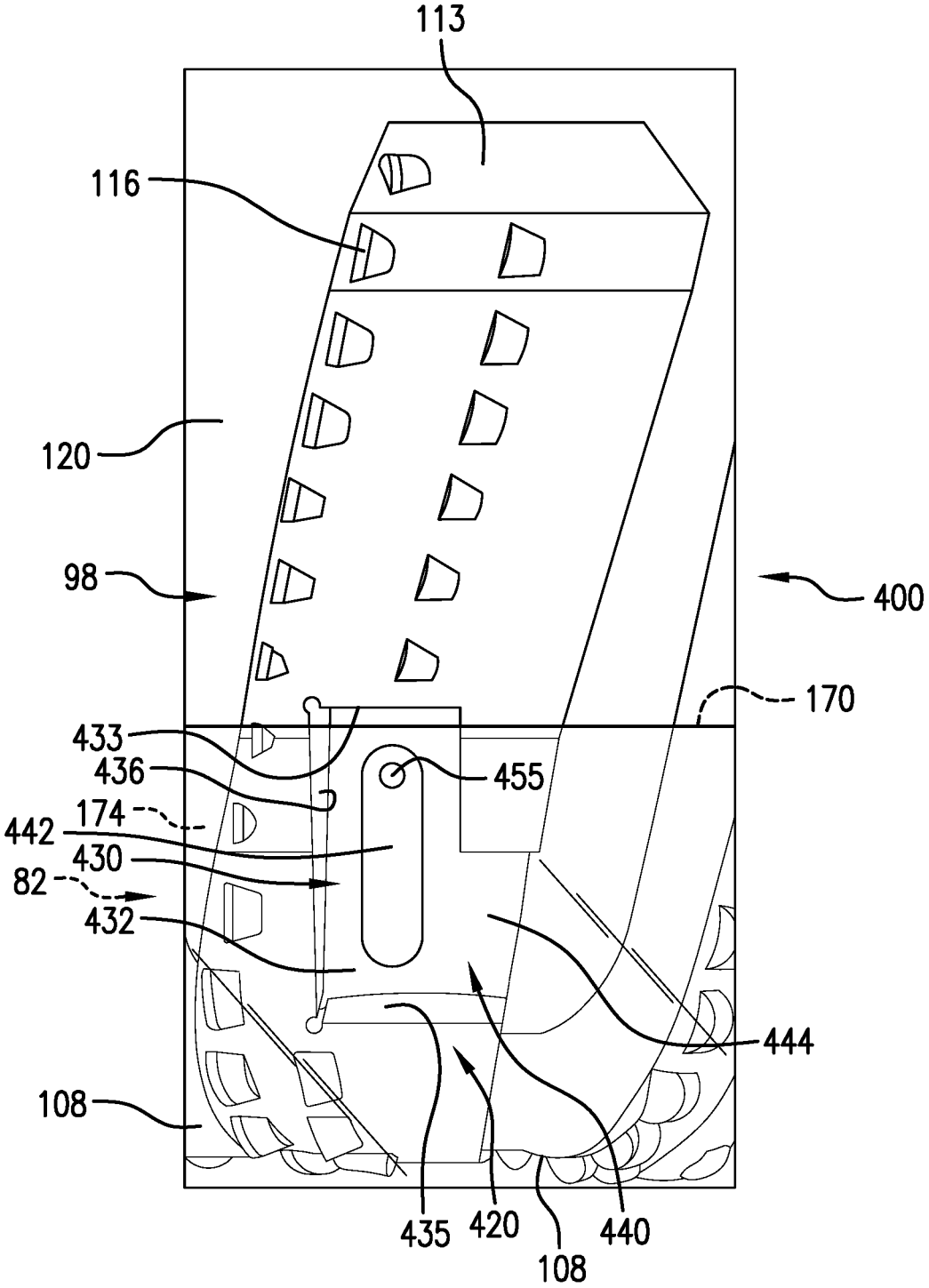
FIG. 12A depicts release system for a window mill and whipstock connector showing the window mill pushing on the whipstock connector in a torque transmitting position, in accordance with still yet another aspect of an exemplary embodiment.
Figure 12B:
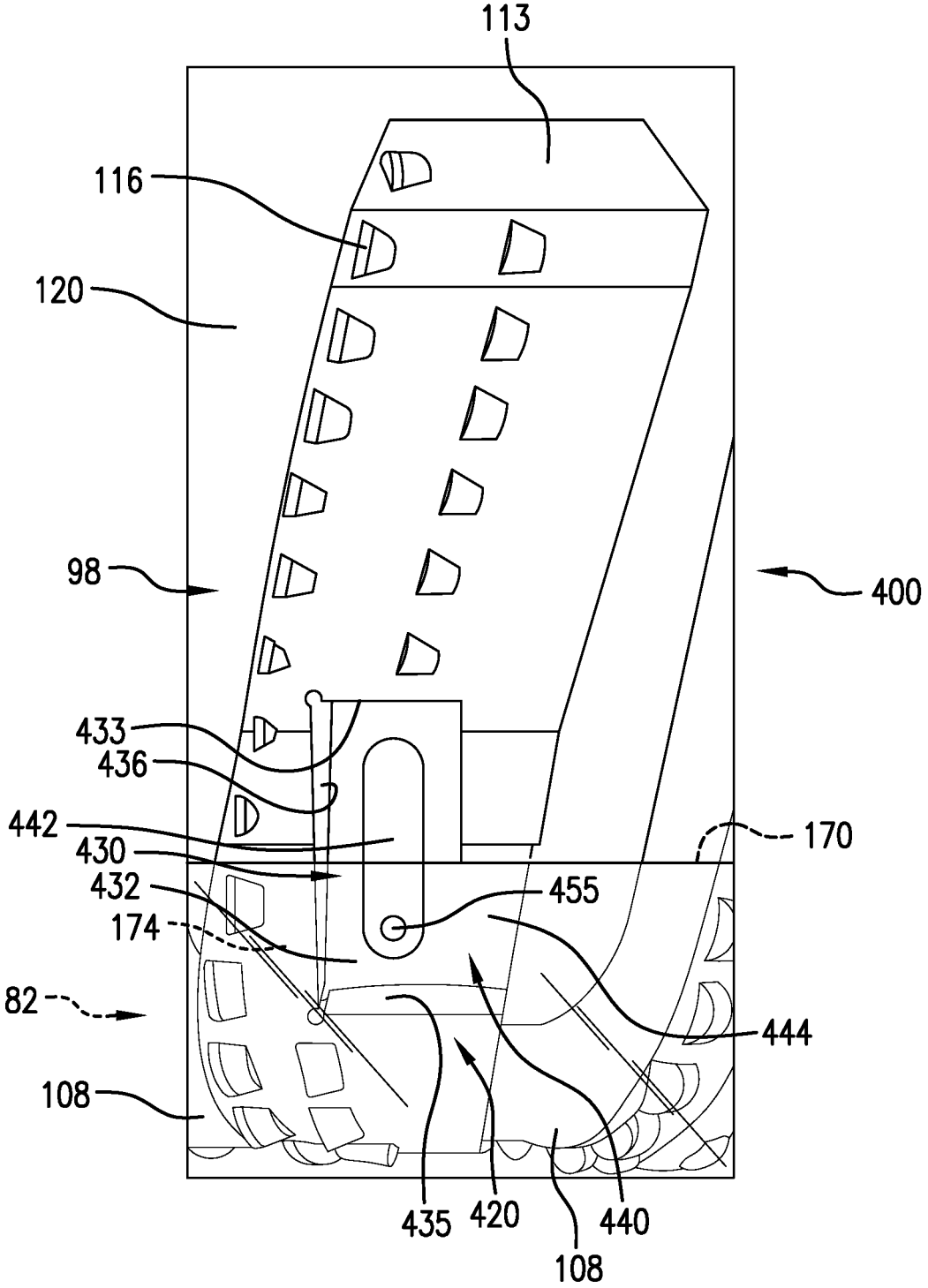
FIG. 12B depicts release system for a window mill and whipstock connector of FIG. 12A in a pre-release position.

Reference will now follow to FIGS. 12A-12B, wherein like reference numbers represent corresponding parts in the respective views, in describing a window mill 400 in accordance with yet another exemplary embodiment. Window mill 400 includes a plurality of lug pockets, one of which is indicated at 420 that provide an interface with whipstock connector 82 as will be detailed herein. Each lug pocket 420 is formed in a corresponding one of the plurality of blades 112, 113 and others.

In the exemplary embodiment shown, each lug pocket 420 is generally L-shaped and includes a longitudinally extending leg 430 including base wall 432, an upper wall 433, a lower wall 435, and a side wall 436. A branch leg 440 extends substantially perpendicularly outwardly of longitudinally extending leg 430. Longitudinally extending leg 430 includes a base wall 436 that extends between upper wall 433 and lower wall 435. Base wall 436 extends into window mill 400 a first depth and includes a longitudinally extending slot 442.

In further accordance with an exemplary aspect, branch leg 440 includes an angled base wall 444 that extends from the first depth of base wall 436 radially outwardly toward a surface (not separately labeled) of window mill 400. As will be detailed herein, angled base wall 444 defines a ramp that allows, for example, lug 180 to transition out of lug pocket 420.

Window mill 400 is coupled to whipstock connector 82 such that each lug 180 enters branch leg 440. Whipstock connector 82 and/or window mill 400 is rotated such that each lug 180 settles between upper wall 433 and lower wall 435. A frangible fastener 455 is threshed into threaded passage 182. Fastener 455 passes through lug 180 and extends into slot 442. With this arrangement, lug 180 is constrained in lug pocket 420 and may travel between upper wall 433 and lower wall 435.

When ready to be installed into wellbore 34, third tubular section 62*c* may be hoisted and lowered into position and held at a rotary table (not shown). Second tubular section 62*b* may be brought into position and connected with third tubular section 62*c*. First tubular section 62*a* may then be connected with second tubular section 62*b* and tubular string 30 run into wellbore 34 to a selected depth at which point anchor 88 may be set.

During run in, it may be desirable to axially load tubular string 30 in compression and/or tension. In compression, lug 180 may travel toward and engage upper wall 433 as shown in FIG. 12B. In tension, lug 180 may travel toward and engage lower wall 435. With this arrangement, the window mill 400/whipstock connector 82 can withstand high loading in both tension and compression. Further, window mill 400 may be rotated such that lug 180 engages side surfaces (not of lug pocket 320 at upper wall 433. Side surface of longitudinal slot 442 at upper wall 433 enables window mill and whipstock 84 to withstand high rotary loads under both clockwise and counter-clockwise rotation. Thus, tubular string may be manipulated to clean internal surfaces of casing 40 with scraper or brush 90.

After setting anchor 88 it may be desired to separate window mill 400 and whipstock connector 82. At such a time, lug 180 is positioned adjacent to lower wall 435 such as by lifting up on tubular string 30. A rotary force is applied to window mill 400 causing frangible fastener 455 to fail, e.g., break shear etc. Lug 180 may then transition up angled base wall 444 and pass out of lug pocket 420. Tubular string 30 may then be lifted to separate window mill 300 from whipstock connector 82.

Figure 13:
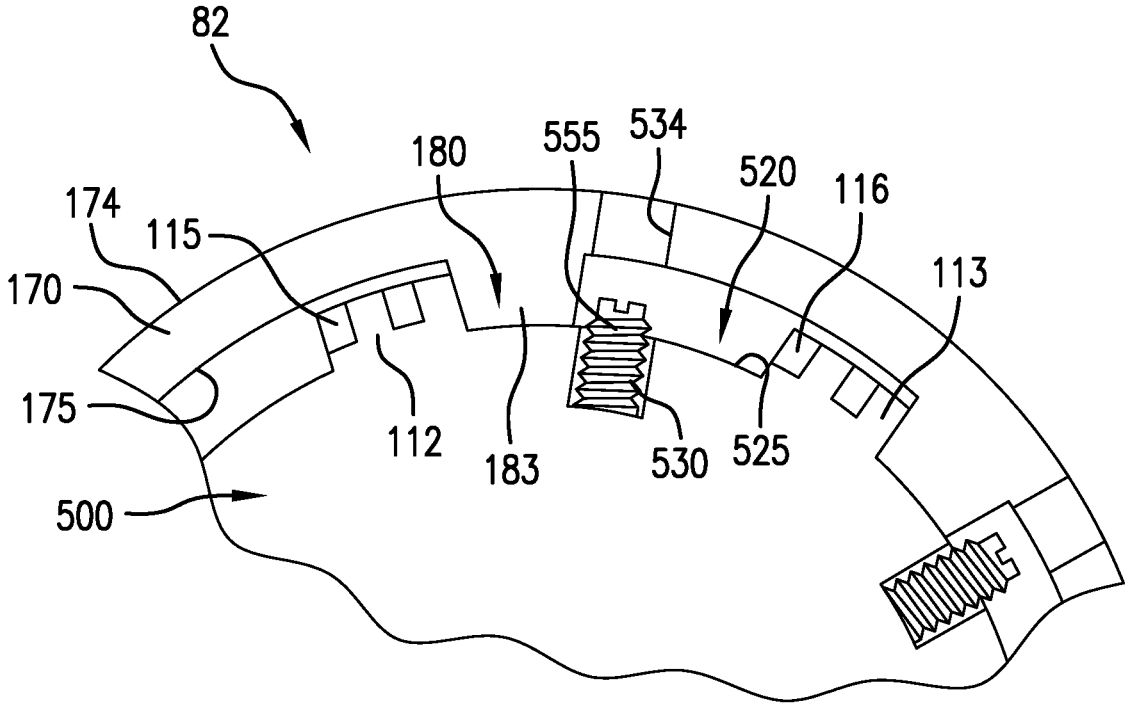
FIG. 13 depicts release system for a window mill and whipstock connector in, in accordance with yet still another aspect of an exemplary embodiment.

Reference will now follow to FIG. 13, wherein like reference numbers represent corresponding parts in the respective views, in describing a window mill 500 in accordance with still yet another aspect of an exemplary embodiment. Window mill 50 includes an elongated lug pocket 520 having a base wall 525. A threaded opening 530 may be provided in base wall 525. Whipstock connector 82 may include un-threaded openings 534 spaced radially from each lug 180.

With this arrangement, each lug 180 is positioned into a corresponding elongated lug pocket 520. Window mill 500 and or whipstock connector 82 may be rotated and a frangible fastener 555 installed through un-threaded opening 534 into threaded opening 530. Frangible fastener 555 allows lug 180 to travel longitudinally in an elongated lug pocket 525. In a manner similar to that described above, elongated lug slot 525 may support compression and tensile loading as well as torsional loading in one direction. Torsional loading in an opposing direction will force lugs 180 against corresponding ones of frangible fasteners 555. Additional torsional loading will cause frangible fasteners to fail allowing window mill 500 to separate from whipstock connector 82 in a manner similar to that described herein.

Set forth below are some embodiments of the foregoing disclosure:

Embodiment 1. A window cutting system comprising: a window mill including a body having a connector member, a tip portion, and a plurality of blades arranged between the connector member and the tip portion, each of the plurality of blades supporting a plurality of cutting elements; a lug pocket formed in at least one of the plurality of blades adjacent the plurality of cutting elements; and a whipstock connector detachably connected to the window mill, the whipstock connector including an outer surface and an inner surface, and at least one lug projecting radially inwardly from the inner surface, the at least one lug being selectively received by the lug pocket to connect the whipstock connector to the window mill.

Embodiment 2. The window cutting system according to any prior embodiment, wherein the lug pocket includes a recess and the lug includes a passage that is alignable with the recess, a shear member extends through the passage into the recess.

Embodiment 3. The window cutting system according to any prior embodiment, wherein the lug pocket includes a base wall having the recess, a first side wall, a second side wall, and a connecting wall extending from the first side wall to the second side wall.

Embodiment 4. The window cutting system according to any prior embodiment, wherein the second side wall includes a chamfered surface and is closer to the tip portion than the first side wall.

Embodiment 5. The window cutting system according to any prior embodiment, wherein the one of the plurality of blades adjacent to the lug pocket includes an increased thickness zone that extends beyond a portion of the plurality of cutting elements.

Embodiment 6. The window cutting system according to claim 2, wherein the lug pocket includes a longitudinally extending leg and a branch leg extending substantially perpendicularly from the longitudinally extending leg.

Embodiment 7. The window cutting system according to any prior embodiment, wherein the longitudinally extending leg includes a base surface having a first depth, an upper surface, and a lower surface and the branch leg includes an angled surface extending from the base surface at the first depth to a surface of the window mill.

Embodiment 8. The window cutting system according to any prior embodiment, wherein the longitudinally extending leg includes a base surface having a first depth, an upper surface, and a lower surface, the branch leg extends from the longitudinally extending leg between the upper surface and the lower surface forming a T-shape allowing a load to be applied to the shear member.

Embodiment 9. The window cutting system according to any prior embodiment, wherein the longitudinally extending leg prevents rotation of the window mill from applying a load on the shear member.

Embodiment 10. The window cutting system according to any prior embodiment, wherein the branch leg extends from the longitudinally extending leg at the upper surface forming an inverted L-shape.

Embodiment 11. The window cutting system according to any prior embodiment, wherein the branch leg extends from the longitudinally extending leg at the lower surface forming a L-shape.

Embodiment 12. The window cutting system according to any prior embodiment, wherein the whipstock connector includes a first end, a second end, and an annular wall, the at least one lug being arranged on the inner surface at the first end.

Embodiment 13. The window cutting system according to any prior embodiment, wherein the second end of the whipstock connector includes a tab element.

Embodiment 14. The window cutting system according to any prior embodiment, further comprising a whipstock coupled to the whipstock connector through the tab element.

Embodiment 15. The window cutting system according to any prior embodiment, wherein the whipstock connector includes a first plurality of openings at the second end and the tab element includes a second plurality of openings, a first plurality of bolts extend through the first plurality of openings into the whipstock and a second plurality of bolts extend through the second plurality of openings into the whipstock.

Embodiment 16. The window cutting system according to any prior embodiment, wherein the lug pocket includes a base wall having a threaded opening, a first side wall, and a second side wall, and frangible fasteners arranged in the threaded opening, the at least one lug being constrained between the frangible fastener and one of the first side wall and the second side wall.

Embodiment 17. A resource exploration and recovery system comprising: a first system; a second system including a casing tubular extending into a formation and a casing window cutting system extending into the casing tubular from the first system, the casing window cutting system comprising: a window mill including a body having a connector member, a tip portion, and a plurality of blades arranged between the connector member and the tip portion, each of the plurality of blades supporting a plurality of cutting elements; a lug pocket formed in at least one of the plurality of blades adjacent the plurality of cutting elements; and a whipstock connector detachably connected to the window mill, the whipstock connector including an outer surface and an inner surface, and at least one lug projecting radially inwardly from the inner surface, the at least one lug being selectively received by the lug pocket to connect the whipstock connector to the window mill.

Embodiment 18. The resource exploration and recovery system according to any prior embodiment, wherein the lug pocket includes a recess and the lug includes a passage that is alignable with the recess, a shear member extends through the passage into the recess.

Embodiment 19. The resource exploration and recovery system according to any prior embodiment, wherein the lug pocket includes a base wall having the recess, a first side wall, a second side wall, and a connecting wall extending from the first side wall to the second side wall.

Embodiment 20. The resource exploration and recovery system according to any prior embodiment, wherein the second side wall includes a chamfered surface and is closer to the tip portion than the first side wall.

Embodiment 21. The resource exploration and recovery system according to any prior embodiment, wherein the one of the plurality of blades adjacent to the lug pocket includes an increased thickness zone that extends beyond a portion of the plurality of cutting elements.

Embodiment 22. The resource exploration and recovery system according to any prior embodiment, wherein the whipstock connector includes a first end, a second end, and an annular wall, the at least one lug being arranged on the inner surface at the first end.

Embodiment 23. The resource exploration and recovery system according to any prior embodiment, wherein the second end of the whipstock connector includes a tab element.

Embodiment 24. The resource exploration and recovery system according to any prior embodiment, further comprising a whipstock coupled to the whipstock connector through the tab element.

Embodiment 25. The resource exploration and recovery system according to any prior embodiment, wherein the whipstock connector includes a first plurality of openings at the second end and the tab element includes a second plurality of openings, a first plurality of bolts extend through the first plurality of openings into the whipstock and a second plurality of bolts extend through the second plurality of openings into the whipstock.

Embodiment 26. The resource exploration and recovery system according to any prior embodiment, wherein the lug pocket includes a base wall having a threaded opening, a first side wall, and a second side wall, and frangible fasteners arranged in the threaded opening, the at least one lug being constrained between the frangible fastener and one of the first side wall and the second side wall.

Embodiment 27. The resource exploration and recovery system according to any prior embodiment, wherein the whipstock connector is welded to a whipstock.

Embodiment 28. A method of assembling a window mill and whipstock prior to deployment into a wellbore, the method comprising: connecting the window mill to a whipstock connector forming a tubular section; raising the tubular section from a well platform after connecting the window mill and the whipstock connector; and installing the tubular section into the wellbore.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A window cutting system comprising:

a window mill including a body having a connector member, a tip portion, and a plurality of blades arranged between the connector member and the tip portion, each of the plurality of blades supporting a plurality of cutting elements, the window mill including a longitudinal axis extending from the connector member through the tip portion;

a lug pocket formed in at least one of the plurality of blades adjacent the plurality of cutting elements, the lug pocket including a recess defined by a base wall, a first side wall and a second side wall axially spaced from the first side wall along the longitudinal axis; and a whipstock connector detachably connected to the window mill, the whipstock connector including an outer surface and an inner surface, and at least one lug projecting radially inwardly from the inner surface, the at least one lug being selectively received by the lug pocket between the first side wall and the second side wall to connect the whipstock connector to the window mill.

2. The window cutting system according to claim 1, wherein the lug pocket includes a recess and the lug includes a passage that is alignable with the recess, a shear member extends through the passage into the recess, wherein the lug isolates the shear member from axial forces.

3. The window cutting system according to claim 2, wherein the one of the plurality of blades adjacent to the lug pocket includes an increased thickness zone that extends beyond a portion of the plurality of cutting elements.

4. The window cutting system according to claim 2, wherein the lug pocket includes a longitudinally extending leg and a branch leg extending substantially perpendicularly from the longitudinally extending leg.

5. The window cutting system according to claim 4, wherein the longitudinally extending leg includes a base surface having a first depth, an upper surface, and a lower surface and the branch leg includes an angled surface extending from the base surface at the first depth to a surface of the window mill.

6. The window cutting system according to claim 5, wherein the longitudinally extending leg includes a base surface having a first depth, an upper surface, and a lower surface, the branch leg extends from the longitudinally extending leg between the upper surface and the lower surface forming a T-shape allowing a load to be applied to the shear member.

7. The window cutting system according to claim 5, wherein the longitudinally extending leg prevents rotation of the window mill from applying a load on the shear member.

8. The window cutting system according to claim 5, wherein the branch leg extends from the longitudinally extending leg at the upper surface forming an inverted L-shape.

9. The window cutting system according to claim 5, wherein the branch leg extends from the longitudinally extending leg at the lower surface forming a L-shape.

10. The window cutting system according to claim 1, wherein the second side wall includes a chamfered surface and is closer to the tip portion than the first side wall.

11. The window cutting system according to claim 1, wherein the whipstock connector includes a first end, a second end, and an annular wall, the at least one lug being arranged on the inner surface at the first end.

12. The window cutting system according to claim 11, wherein the second end of the whipstock connector includes a tab element.

13. The window cutting system according to claim 12, further comprising a whipstock coupled to the whipstock connector through the tab element.

14. The window cutting system according to claim 13, wherein the whipstock connector includes a first plurality of openings at the second end and the tab element includes a second plurality of openings, a first plurality of bolts extend through the first plurality of openings into the whipstock and a second plurality of bolts extend through the second plurality of openings into the whipstock.

15. The window cutting system according to claim 1, wherein the lug pocket includes a base wall having a threaded opening, a first side wall, and a second side wall, and a frangible fastener arranged in the threaded opening, the at least one lug being constrained between the first side wall and the second side wall isolating the frangible fastener from axial forces.

16. A resource exploration and recovery system comprising:

a first system;

a second system including a casing tubular extending into a formation and a casing window cutting system extending into the casing tubular from the first system, the casing window cutting system comprising:

a window mill including a body having a connector member, a tip portion, and a plurality of blades arranged between the connector member and the tip portion, each of the plurality of blades supporting a plurality of cutting elements, the window mill including a longitudinal axis extending from the connector member through the tip portion;

a lug pocket formed in at least one of the plurality of blades adjacent the plurality of cutting elements, the lug pocket including a recess defined by a base wall, a first side wall and a second side wall axially spaced from the first side wall along the longitudinal axis; and a whipstock connector detachably connected to the window mill, the whipstock connector including an outer surface and an inner surface, and at least one lug projecting radially inwardly from the inner surface, the at least one lug being selectively received by the lug pocket between the first side wall and the second side wall to connect the whipstock connector to the window mill.

17. The resource exploration and recovery system according to claim 16, wherein the lug pocket includes a recess and the lug includes a passage that is alignable with the recess, a shear member extends through the passage into the recess, wherein the lug isolates the shear member from axial forces.

18. The resource exploration and recovery system according to claim 16, wherein the second side wall includes a chamfered surface and is closer to the tip portion than the first side wall.

19. The resource exploration and recovery system according to claim 18, wherein the one of the plurality of blades adjacent to the lug pocket includes an increased thickness zone that extends beyond a portion of the plurality of cutting elements.

20. The resource exploration and recovery system according to claim 16, wherein the whipstock connector includes a first end, a second end, and an annular wall, the at least one lug being arranged on the inner surface at the first end.

21. The resource exploration and recovery system according to claim 20, wherein the second end of the whipstock connector includes a tab element.

22. The resource exploration and recovery system according to claim 21, further comprising a whipstock coupled to the whipstock connector through the tab element.

23. The resource exploration and recovery system according to claim 22, wherein the whipstock connector includes a first plurality of openings at the second end and the tab element includes a second plurality of openings, a first plurality of bolts extend through the first plurality of openings into the whipstock and a second plurality of bolts extend through the second plurality of openings into the whipstock.

24. The resource exploration and recovery system according to claim 16, wherein the lug pocket includes a base wall having a threaded opening, a first side wall, and a second side wall, and a frangible fastener arranged in the threaded opening, the at least one lug being constrained between the first side wall and the second side wall isolating the frangible fastener from axial forces.

25. The resource exploration and recovery system according to claim 16, wherein the whipstock connector is welded to a whipstock.

26. A method of assembling a window mill and whipstock prior to deployment into a wellbore, the method comprising:

connecting the window mill having a longitudinal axis to a whipstock connector with a shear member to form a tubular section;

positioning a lug on the whipstock connector in between first and second side walls spaced one from another along the longitudinal axis of a lug pocket formed in the window mill to isolate the shear member from axial forces;

raising the tubular section from a well platform after connecting the window mill and the whipstock connector; and installing the tubular section into the wellbore.

27. The method of claim 26, further comprising: breaking the shear member by rotating the window mill relative to the whipstock connector.

* * * * *